US006913450B2

(12) United States Patent
Hong et al.

(10) Patent No.: US 6,913,450 B2
(45) Date of Patent: Jul. 5, 2005

(54) SUCTION VALVE COUPLING STRUCTURE FOR RECIPROCATING COMPRESSOR

(75) Inventors: Seong-Joon Hong, Pyungtaik (KR); Bon-Cheol Ku, Kimhae (KR); Hyeong-Suk Kim, Changwon (KR); Hyung-Pyo Yoon, Changwon (KR)

(73) Assignee: LG Electronics, Inc. (KR)

( * ) Notice: Subject to any disclaimer, the term of this patent is extended or adjusted under 35 U.S.C. 154(b) by 34 days.

(21) Appl. No.: 10/344,548

(22) PCT Filed: Jun. 26, 2001

(86) PCT No.: PCT/KR01/01089

§ 371 (c)(1),
(2), (4) Date: Feb. 11, 2003

(87) PCT Pub. No.: WO03/001061

PCT Pub. Date: Jan. 3, 2003

(65) Prior Publication Data

US 2003/0180168 A1 Sep. 25, 2003

(51) Int. Cl.[7] ..... F04B 39/10

(52) U.S. Cl. ..... 417/545; 417/555.1; 417/552; 137/512.15; 137/315.33

(58) Field of Search ..... 417/545, 555.1, 417/552; 137/512.15, 855, 315.33

(56) References Cited

U.S. PATENT DOCUMENTS

| | | | | | |
|---|---|---|---|---|---|
| 325,074 | A | * | 8/1885 | Gordon | 137/315.33 |
| 3,568,712 | A | * | 3/1971 | Rinehart | 137/855 |
| 5,163,819 | A | * | 11/1992 | Pettitt | 417/269 |
| 5,284,289 | A | * | 2/1994 | Killian | 228/165 |
| 6,152,710 | A | * | 11/2000 | Oh et al. | 417/570 |
| 6,220,393 | B1 | * | 4/2001 | Oh et al. | 184/6.16 |
| 6,227,825 | B1 | * | 5/2001 | Vay | 417/569 |
| 6,398,523 | B1 | * | 6/2002 | Hur et al. | 417/417 |
| 6,484,714 | B1 | * | 11/2002 | Smith | 126/525 |
| 2003/0156956 | | * | 8/2003 | Park et al. | 417/416 |

FOREIGN PATENT DOCUMENTS

| | | | |
|---|---|---|---|
| EP | 0 674 963 | A1 * | 3/1995 |
| JP | 02223685 | | 9/1990 |
| JP | 09151843 | | 6/1997 |
| JP | 10113221 | A * | 5/1998 |
| JP | 11182424 | | 7/1999 |
| KR | 100186473 | | 12/1998 |
| SU | 914216 | B * | 3/1982 |

OTHER PUBLICATIONS

English translation of Abstract for Korean patent application number 10–0186473 dated Dec. 29, 1998.
English translation of Abstract for Japanese patent application number 11–182424 dated Jul. 6, 1999.
English translation of Abstract for Japanese patent application number 09–151842 dated Jun. 10, 1997.
English translation of Abstract for Japanese patent application number 02–223685 dated Sep. 6, 1990.

* cited by examiner

*Primary Examiner*—Cheryl Tyler
*Assistant Examiner*—Emmanuel Sayoc
(74) *Attorney, Agent, or Firm*—Ostrolenk, Faber, Gerb & Soffen, LLP

(57) ABSTRACT

A suction valve coupling structure for a reciprocating compressor is disclosed in which a piston being linearly moved in a cylinder upon receipt of driving force from an electric mechanism unit, according to which gas flows through a gas flow passage formed therein, is coupled by welding to a valve for opening and closing the gas flow passage, thereby strengthening the coupling state of the suction valve. Since the coupling structure is simplified, a dead volume is reduced and a stroke volume is increased, improving compression efficiency. A stroke control of the piston is facilitated to enable a precise control of movement of the piston. In addition, a reliability of the coupling of the suction valve can be improved.

11 Claims, 10 Drawing Sheets

SUCTION VALVE COUPLING STRUCTURE FOR RECIPROCATING COMPRESSOR

TECHNICAL FIELD

The present invention relates to a reciprocating compressor, and particularly to a suction valve coupling structure for a reciprocating compressor, in which the suction valve for opening and closing a gas flow passage is firmly coupled and the coupling structure is simplified, thereby minimizing a dead volume.

BACKGROUND ART

Conventionally, a compressor is a device for compressing a fluid such as air and refrigerant gas. The compressor includes a motor unit installed in the hermetic container for generating driving force, and a compression unit for sucking and compressing gas by receiving the driving force of the motor unit. In the compressor, if a power source is applied to generate the driving force in the motor unit, the driving force is transmitted to the compression unit, thereby sucking, compressing, and discharging gas in the compression unit.

A reciprocating compressor is a device, in which a piston is coupled to an armature of a reciprocating motor as a unit without a crank axis. FIG. 1 shows an embodiment of the conventional reciprocating compressor.

As shown in FIG. 1, the conventional reciprocating compressor comprises a ring shaped frame 1 supported by an elastic supporting member (not shown) in a casing V; a cylindrical cover 2 fixed at one side surface of the frame 1; a cylinder 3 fixed as a horizontal direction in the middle of the frame 1; an inner stator assembly 4A fixed at an outer circumference surface of an inner side of the frame 1 supporting the cylinder 3, and an outer stator assembly 4B fixed at an inner circumference surface of an outer side of the frame 1 apart from the outer circumference surface of the inner stator assembly 4A with a predetermined air-gap; an armature 5 inserted in the gap between the inner stator assembly 4A and the outer stator assembly 4B for consisting of the armature of the reciprocating compressor; a piston 6 fixed to the armature 5 as a unit for sucking and compressing refrigerant gas by having a slidable movement at the inner portion of the cylinder 3; an inner resonant spring 7A supported at one side surface of the frame 1 and at an inner side of the armature 5 unified with the piston 6 for having a resonant movement; an outer resonant spring 7B supported at an inner side surface of the cover 2 and at an outer side of the armature 5 unified with the piston 6 for having a resonant movement; and a discharge valve assembly 8 mounted at an end portion of a discharge side of the cylinder 3 for limiting a discharge of the compressed gas at the time when the piston 6 reciprocates.

Unexplained reference numeral 8*a* denotes a discharge valve, 8*b* denotes a spring for supporting the discharge valve, 8*c* denotes a discharge cover, SP denotes a suction pipe, and DP denotes a discharge pipe.

The conventional reciprocating compressor is operated as follows.

That is, if an electric current is applied to the inner and outer stator assemblies 4A and 4B and the movable 5 has a linear reciprocation, the piston 6 coupled to the armature 5 linearly reciprocates in the cylinder 3, thereby generating a pressure difference in the cylinder 3. By the pressure difference, refrigerant gas in the casing V is sucked in the cylinder through a refrigerant flow passage F of the piston 6, compressed, and discharged, which is repeated.

In the meantime, FIG. 2 is a perspective view showing a suction valve coupling structure for a reciprocating compressor in accordance with the conventional art, and FIG. 3 is a sectional view showing a suction valve coupling structure for a reciprocating compressor in accordance with the conventional art.

As depicted, a suction valve 9 for limiting a suction of refrigerant gas which passed through the refrigerant flow passage F and a refrigerant suction hole 6*e* is fixed to a frontal surface of a head portion 6*b* of the piston 6 by a fixation bolt B.

Also, the suction valve 9 is formed as a thin disc plate corresponding to an end portion surface S of the head portion 6*b* of the piston 6.

A cut-off 9*c* of an opened curve line shape is formed in the disc plate, and has a shape of a question mark, in which the disc plate is divided into a circle shaped part and a ring shaped part.

The circle shaped part constitutes a fixation portion 9*d* coupled to the head portion 6*b* of the piston 6, and the ring shaped part corresponding to an outer portion of the circle shaped part constitutes an open/close portion 9*a* for opening and closing the refrigerant suction hole 6*e*. In the meantime, the suction valve 9 is made from high carbon spring steel which is generally used, and the piston 6 is made from cast iron having an excellent foundry characteristic.

A structure for coupling the suction valve 9 to the piston 6 is as followings. First, a screw hole 6*d* is formed in the middle of the end portion surface S of the head portion 6*b* of the piston 6, and a through hole 9*b* for coupling the valve is formed at the fixation portion 9*d* of the suction valve 9. Then, under a state that the through hole 9*b* of the suction valve 9 and the screw hole 6*d* of the piston 6 are unified, the suction valve 9 is coupled to the piston 6 by inserting the fixation bolt B.

However, in the conventional suction valve coupling structure, since the suction valve 9 formed as a thin plate is coupled by the fixation bolt B, the fixation bolt is minutely loosened in a process that the suction valve 9 is repeatedly opened and closed, which causes a slip rotation of the suction valve 9. According to this, the suction valve deviates from the refrigerant suction hole 6*e*, thereby lowering a reliability of the compressor.

Also, since a head portion of the fixation bolt B is protruded at an inner portion of the compression space P, a dead volume is generated. According to this, not only compression efficiency is lowered, but also a precise location sensing of an upper dead point and a lower dead point of the piston 6 is not possible by the protruded head portion of the fixation portion B, thereby having a problem to control a stroke for a reciprocal movement of the piston 6.

TECHNICAL GIST OF THE PESENT INVENTION

Therefore, an object of the present invention is to provide a suction valve coupling structure for a reciprocating compressor, in which the suction valve for opening and closing a gas flow passage is firmly coupled and the coupling structure is simplified, thereby minimizing dead volume.

DETAILED DESCRIPTION OF THE INVENTION

In order to achieve the above objects, there is provided a suction valve coupling structure for a reciprocating compressor, the reciprocating compressor comprising: a piston for linearly reciprocating in a cylinder with an armature of a reciprocating motor and having a refrigerant flow passage connected to the end portion surface thereof; and a suction valve arranged at the end portion surface of the piston for opening and closing the refrigerant flow passage, wherein a welding member mounting recess of a predetermined depth for mounting the suction valve is formed at the end portion surface of the piston.

Also, in order to achieve the above objects, there is provided a suction valve coupling structure for a reciprocating compressor, in which the suction valve is coupled to the piston by welding a lateral side surface thereof to a corresponding surface of the piston.

MODE FOR CARRYING OUT THE PREFERRED EMBODIMENTS

The present invention will now be described with reference to accompanying drawings.

Figure 1:
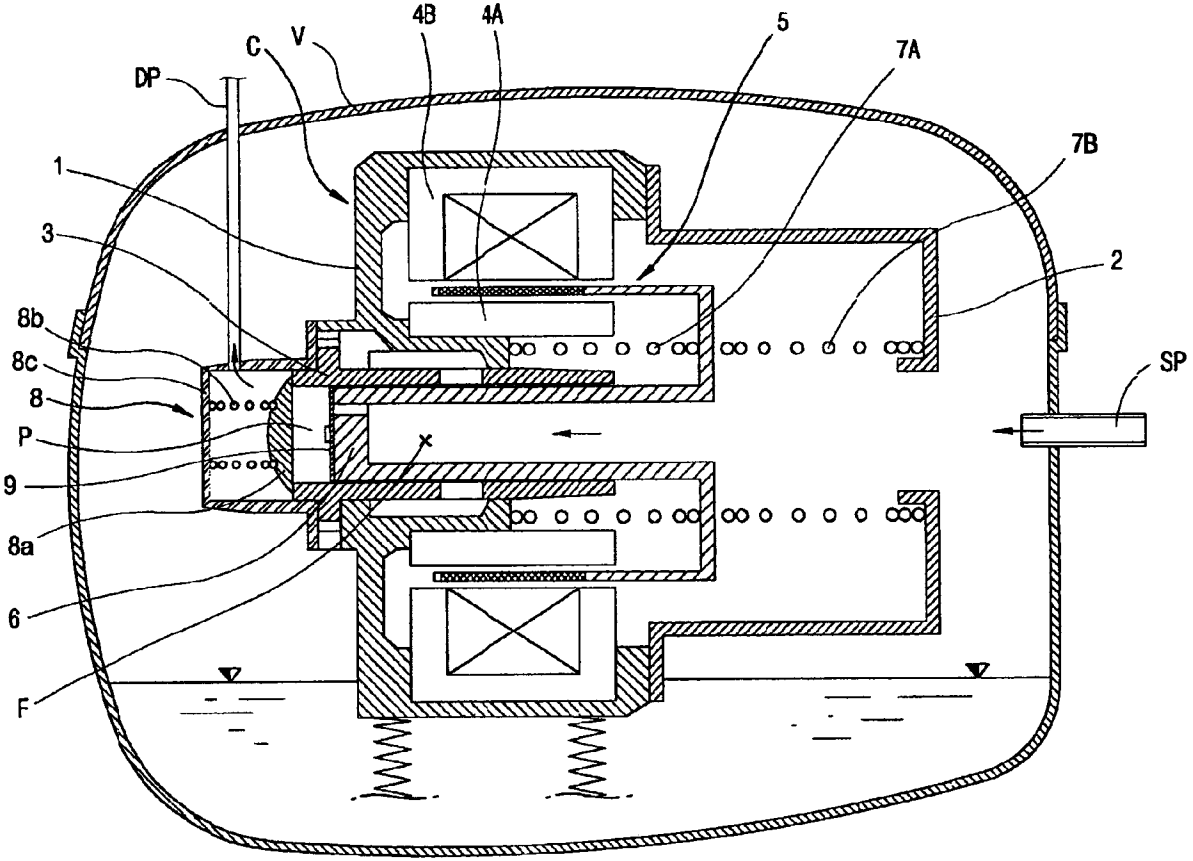
FIG. 1 CONVENTIONAL ART
FIG. 1 is a longitudinal section view showing one embodiment of the conventional reciprocating compressor.
Figure 2:
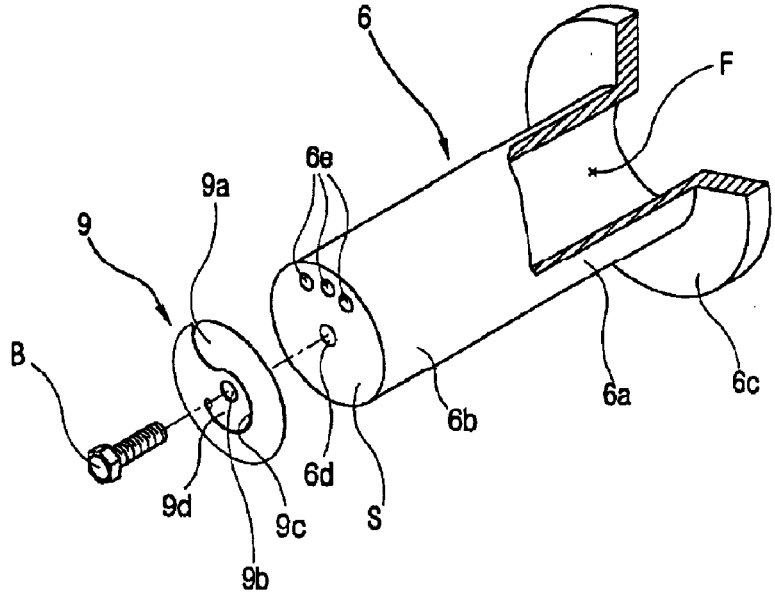
FIG.2 CONVENTIONAL ART
FIG. 2 is a perspective view showing a suction valve coupling structure for the conventional reciprocating compressor.
Figure 3:
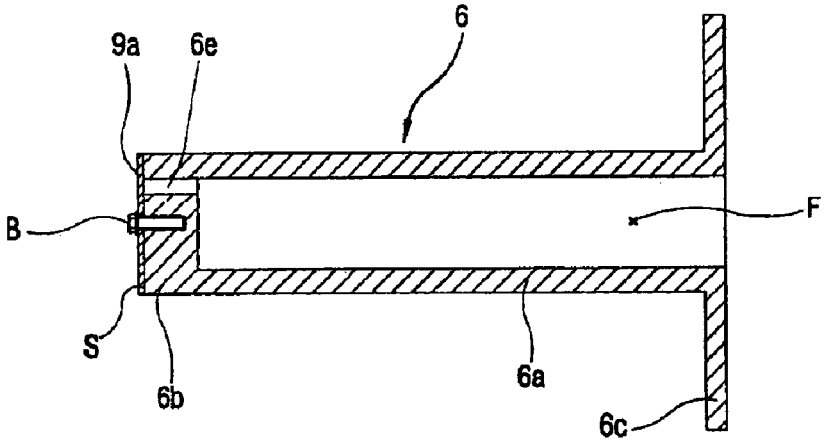
FIG.3 CONVENTIONAL ART
FIG. 3 is a sectional view showing the suction valve coupling structure for the conventional reciprocating compressor.
Figure 4:
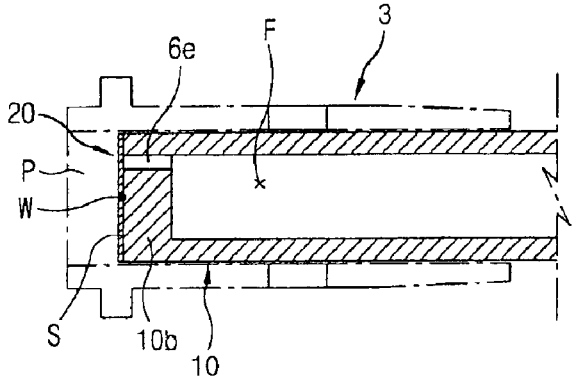
FIG. 4 is a sectional view showing a first preferred embodiment of a suction valve coupling structure for a reciprocating compressor according to the present invention.

FIG. 4 is a sectional view showing a first preferred embodiment of the suction valve coupling structure for a reciprocating compressor according to the present invention. Referring to FIG. 4, a refrigerant flow passage F for circulating refrigerant gas is formed to penetrate an inner portion of the piston 10 inserted in the cylinder 3, and a plurality of refrigerant suction holes 6*e* are formed at the end portion surface S of the piston head portion 10*b* in the piston 10.

A suction valve 20 for opening and closing the refrigerant suction holes 6*e* is directly connected to the piston 10 by welding. At this time, the suction valve 20 is formed as a thin disc plate having an area corresponding to the end portion surface S of the piston 10.

The welding preferably includes a resistance spot welding, a laser welding, and a tig welding. An unexplained reference numeral W denotes a welding point.

Figure 5:
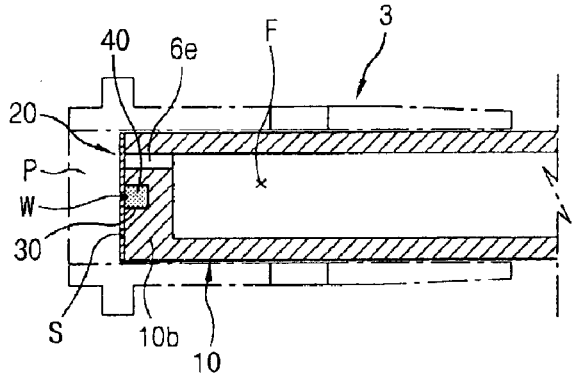
FIG. 5 is a sectional view showing another example of the first preferred embodiment of the suction valve coupling structure for a reciprocating compressor according to the present invention.

FIG. 5 shows a modification example of the first preferred embodiment of the present invention. Referring to FIG. 5, a reception recess 30 having a predetermined size is formed at the piston which reciprocates linearly in the cylinder 3 by receiving driving force of the motor unit and has a refrigerant flow passage F for introducing refrigerant gas therein. The reception recess 30 is formed as a recess form having a predetermined depth and an inner diameter. Also, an insertion member 40 having an excellent welding characteristic is fixed to an inner portion of the reception recess 30.

The insertion member 40 having an excellent welding characteristic is formed correspondingly to a shape of the reception recess 30, and preferably made from low carbon steel and stainless steel.

At this time, the insertion member 40 is fixed to an inner portion of the reception recess 30 by brazing. The suction valve 20 for opening and closing the refrigerant flow passage F is connected to the insertion member 40 by welding.

The suction valve 20 is formed as a thin plate having an area corresponding to the end portion surface S of the piston 10, and the welding between the insertion member 40 and the suction valve 20 preferably includes a resistance spot welding, a laser welding, and a tig welding.

In the structure, a welding intensity of the suction valve 20 is enhanced by welding the suction valve 20 with the insertion member 40 having an excellent welding characteristic.

Figure 6:
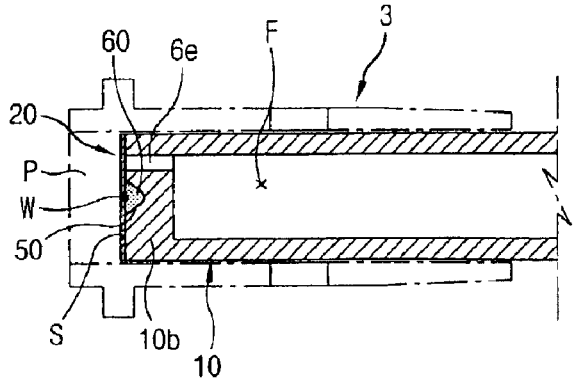
FIG. 6 is a sectional view showing other example of the first preferred embodiment of the suction valve coupling structure for a reciprocating compressor according to the present invention.

In the meantime, FIG. 6 shows another modification example of the first preferred embodiment of the present invention. Referring to FIG. 6, a reception recess 50 having a predetermined size is formed at the piston 10 which has a linear reciprocation in the cylinder 3 by receiving driving force of the motor unit and having a refrigerant flow passage F for introducing refrigerant gas therein.

Then, a welding material 60 having an excellent welding characteristic is directly welded to the reception recess 50 of the piston 10, so that the welding material 60 is melted and fills the reception recess 50. The welding material 60 is preferably Ni-based groups.

Then, the suction valve 20 for opening and closing the refrigerant flow passage F of the piston 10 is welded with the welding material 60 which fills the reception recess 50.

The suction valve 20 is formed as a thin plate having an area corresponding to the end portion surface S of the piston 10, and the welding between the insertion member 40 and the suction valve 20 preferably includes a resistance spot welding, a laser welding, and a tig welding.

In the structure, a welding intensity of the suction valve 20 is enhanced by welding the suction valve 20 with the welding material 60 having an excellent welding characteristic.

Hereinafter, operations and effects of the first preferred embodiment of the suction valve coupling structure for a reciprocating compressor according to the present invention will be explained.

First, if driving force of the motor unit is transmitted to the piston 10, and the piston 10 has a linear reciprocation in the cylinder 3, refrigerant gas is sucked in the compression space P of the cylinder 3 through the refrigerant flow passage F formed at an end portion of the piston 10, compressed, and discharged by opening and closing of the discharge valve 8*a* which constitutes a discharge valve assembly 8, which is repeated.

In said process, since the suction valve 40 for opening and closing the refrigerant flow passage F is coupled to the piston 10 by welding, the coupling state is firm and a slip rotation is not generated even in a process that the suction valve 20 is repeatedly opened and closed, thereby having an excellent compression performance.

Also, since the suction valve 20 does not have a protruded portion toward an outer side thereof and is simplified as a flat state, not only a dead volume of the compression space P is excluded, but also a precise location sensing of an upper dead point and a lower dead point of the piston 10 is possible, thereby controlling a stroke easily for a reciprocal movement of the piston 10.

Hereinafter, the second preferred embodiment of the suction valve coupling structure for a reciprocating compressor according to the present invention will be explained with reference to the preferred embodiment illustrated in the attached drawings.

Figure 7:
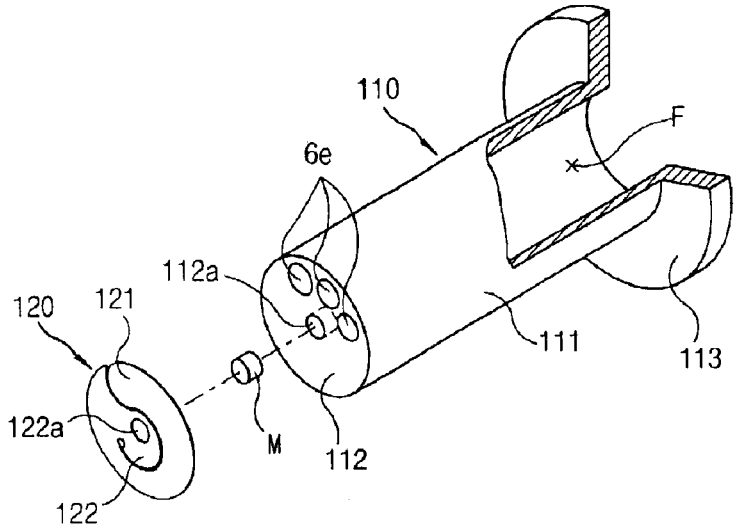
FIG. 7 is a perspective view showing a second preferred embodiment of the suction valve coupling structure for a reciprocating compressor according to the present invention.
Figure 8:
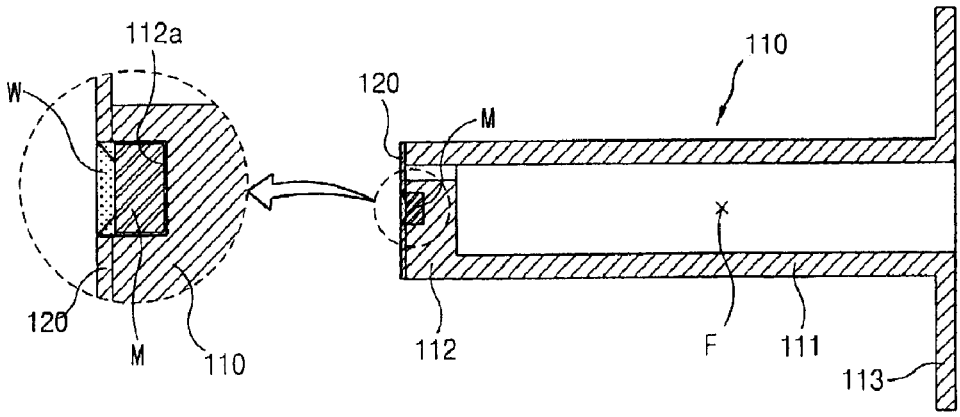
FIG. 8 is a sectional view showing the second preferred embodiment of the suction valve coupling structure for a reciprocating compressor according to the present invention.
Figure 9:
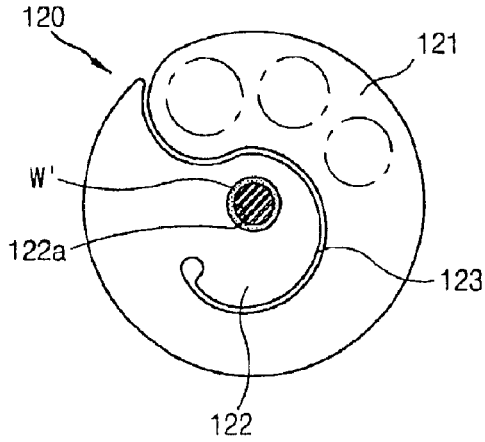
FIG. 9 is a frontal view showing a location of a welding portion of the second preferred embodiment of the suction valve coupling structure for a reciprocating compressor according to the present invention.
Figure 10:
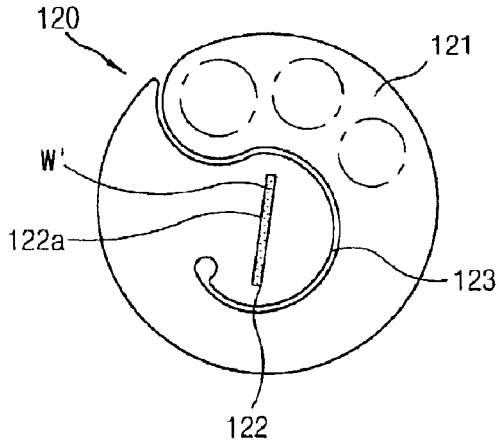
FIG. 10 is a frontal view showing another location of the welding portion of the second preferred embodiment of the suction valve coupling structure for a reciprocating compressor according to the present invention.

FIGS. 7 and 8 are perspective and longitudinal section views showing a second preferred embodiment of the suction valve coupling structure for a reciprocating compressor according to the present invention, and FIGS. 9 and 10 are frontal views showing another locations of a welding portion of the second preferred embodiment of the suction valve coupling structure for a reciprocating compressor according to the present invention.

As shown, in the suction valve coupling structure for a reciprocating compressor according to the present invention, the suction valve is arranged to an end portion surface of the piston 110 which is coupled to the armature 5 of the reciprocating motor and slidably inserted in the cylinder 3, thereby welding a lateral section surface of the suction valve 120 for opening and closing the refrigerant flow passage F of the piston 110 to a corresponding side of the piston by a laser welding or an electron beam welding which do not generate arc. According to this, parts which receive heat influence of the welding are minimized, and a protrusion by the welding scale is not generated.

The piston 110 includes a body portion 111 having a predetermined length, a head portion 112 at a forward side of the body portion 111, a connection portion 113 connected to the armature 5 at a rear side of the body portion 111 and a refrigerant flow passage F formed in the middle of the body portion 111 and at one side of the head portion 112 for guiding refrigerant gas into the cylinder 3.

A welding material insertion recess 112*a* for forcibly inserting welding material M which will be explained later is formed in the middle of the head portion 112 to weld the suction valve 120. Also, a plurality of refrigerant suction holes 6*e* (three holes in drawing) are formed at an edge of the head portion 112.

The welding material M is preferably formed with material which makes the suction valve 120 of strong elasticity material be smoothly welded.

Also, a cut-off 123 of the suction valve 120 is formed as a question mark shape, and an open/close portion 121 thereof is oppositely arranged to open and close the refrigerant suction holes 6*e* of the head portion 112. A welding hole 122*a* corresponding to an end portion surface of the welding material M is formed at a fixation portion 122 located at a center of the suction valve.

As shown in FIG. 9, the welding hole 122*a* is formed as a disc shape, thereby welding an inner circumference surface thereof to the end portion surface of the welding material M, or, as shown in FIG. 10, the welding hole 122*a* is formed as a rectangular slit shape, thereby welding an inner section surface thereof to the end portion surface of the welding material M.

An unexplained reference numeral W denotes a welding portion.

The second preferred embodiment of the suction valve coupling structure for a reciprocating compressor according to the present invention has the following operation effects.

That is, if a power source is applied to the reciprocating motor and the armature 5 has a linear reciprocation, the piston 110 coupled to the armature 5 linearly reciprocates in the cylinder 3, thereby sucking refrigerant gas in the hermetic container V. compressing and discharging, which is repeated.

At this time, when the piston 10 reciprocates, if the piston 110 has a forward movement to compress the refrigerant gas sucked in the cylinder 3, the refrigerant gas in the compression space of the cylinder 3 is gradually compressed as a volume of the compression space narrows, and if a pressure of the compression space is above a predetermined value, the refrigerant gas is discharged by pushing the discharge valve 8*a* which shields a discharge side of the compression space. At this time, a stroke distance of the piston 10 can be set not to generate a dead volume between the suction valve 120 and the corresponding discharge valve 8*a* by coupling the suction valve 120 located at the end portion surface of the piston 10 to the piston 110 by welding.

Also, the welding material M having an excellent welding characteristic to the suction valve 120 is forcibly inserted to the end portion surface of the piston 110, so that the welding material M is welded to the suction valve 120, thereby increasing the welding characteristic. Also, since a lateral section surface of the suction valve 120 is welded to the end portion surface of the piston 110 or the end portion surface of the welding material M, coupling force of the two members is divided into a vertical direction and a horizontal direction, thereby having greater resistance in opening and closing the suction valve 120 as one direction, minimizing influence by welding heat, and not generating a protrusion by the welding scale.

In the meantime, the second preferred embodiment of the reciprocating compressor according to the present invention has modification examples in case of the followings.

Figure 11:
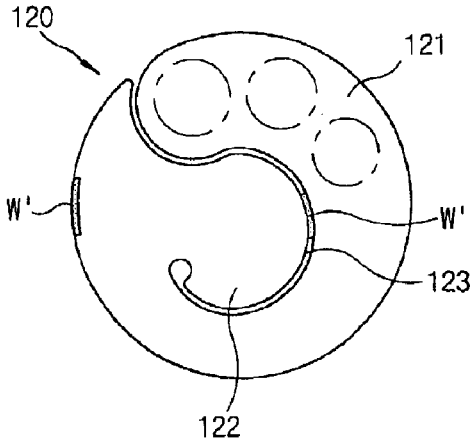
FIG. 11 is a frontal view showing other location of the welding portion of the second preferred embodiment of the suction valve coupling structure for a reciprocating compressor according to the present invention.

That is, in the aforementioned preferred embodiment, an additional welding hole 122*a* of a circular shape or a rectangular slit shape is formed at the fixation portion 122 of the suction valve 120, so that a lateral section surface of the welding hole 122*a* is welded to the welding material M forcibly inserted to the piston 110. However, in the modification example, as shown in FIG. 11, a lateral section surface of the cut-off 123 for cutting the suction valve 120 to classify into the open/close portion 121 and the fixation portion 122 can be welded to the welding material M of the piston 110, or an outer circumference surface of the suction valve 120 can be welded to an outer circumference surface of the piston 110 parallel thereto without forming an additional welding hole.

In said case, an additional welding hole need not to be formed, and a welding coupling force is increased by having the two welding portions.

Hereinafter, the third preferred embodiment of the suction valve coupling structure for a reciprocating compressor according to the present invention will be explained with reference to the preferred embodiment illustrated in the attached drawings.

Figure 12:
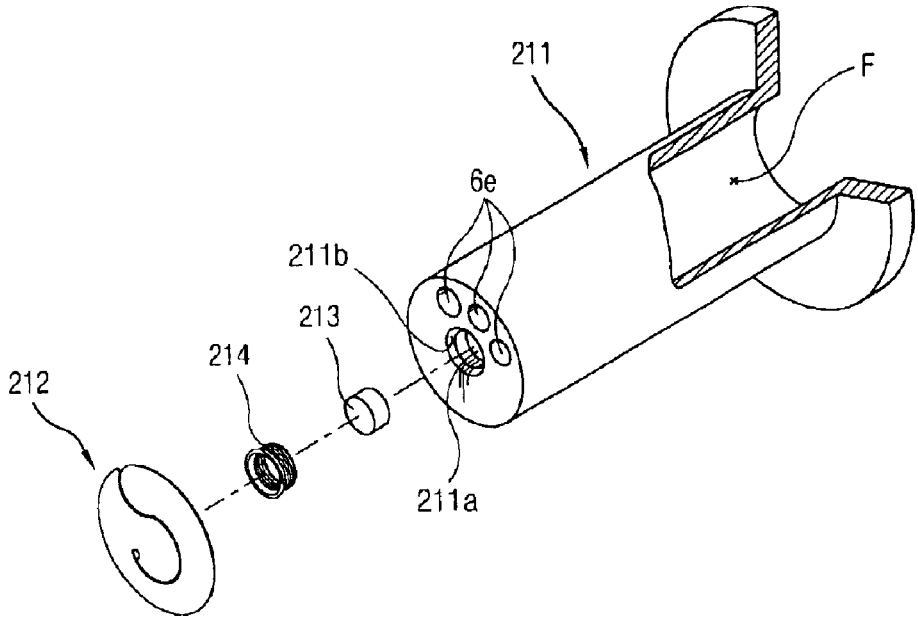
FIG. 12 is a perspective view showing a third preferred embodiment of the suction valve coupling structure for a reciprocating compressor according to the present invention.
Figure 13:
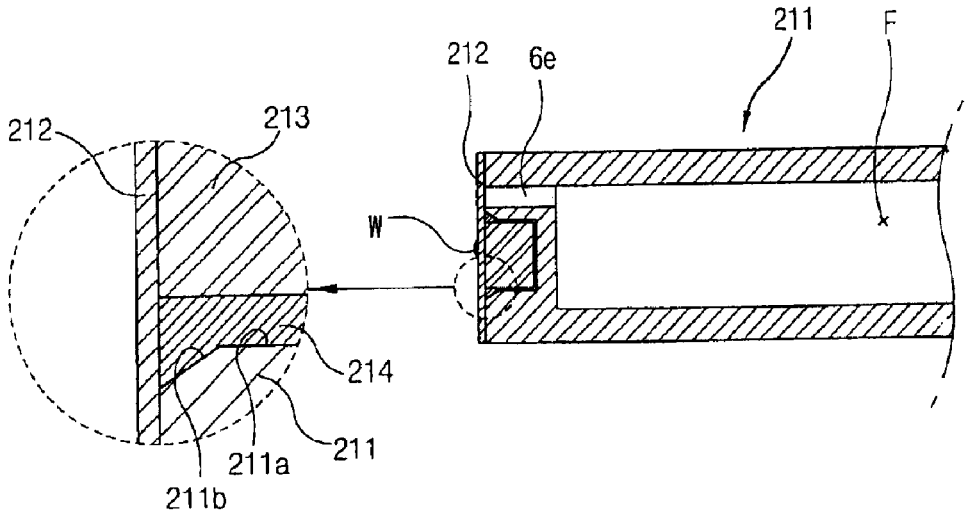
FIG. 13 is a longitudinal section view showing the third preferred embodiment of the suction valve coupling structure for a reciprocating compressor according to the present invention.
Figure 14:
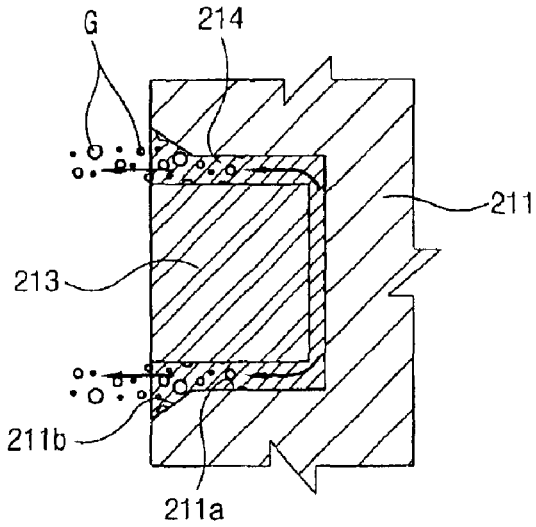
FIG. 14 is a longitudinal section view showing a process that a welding member is welded to the piston in the third preferred embodiment of the suction valve coupling structure for a reciprocating compressor according to the present invention.

FIG. 12 is a disassembled perspective view showing one preferred embodiment of the piston of the suction valve coupling structure for a reciprocating compressor according to the present invention, FIG. 13 is an assembled longitudinal section view showing the one preferred embodiment of the piston of the suction valve coupling structure for a reciprocating compressor according to the present invention, and FIG. 14 is a longitudinal section view showing a process that a welding member is welded to the piston.

As shown, the suction valve coupling structure for a reciprocating compressor according to the present invention comprises a piston 211 coupled to the armature of the reciprocating motor (not shown) and slidably inserted to the cylinder 3 for sucking refrigerant gas in the compression space of the cylinder 3, compressing, and discharging; a suction valve 212 mounted at an end portion surface of the piston 211 for opening and closing the refrigerant flow passage F of the piston 211; and a welding member 213 inserted between the end portion surface of the piston 211 and the corresponding suction valve 212 and mounted at the end portion surface of the piston 211 to enhance a welding characteristic of the suction valve 212.

The piston 211 is generally made of cast iron and provided with a welding member mounting recess 211*a* for inserting the welding member 213 at a center of the end portion surface thereof. A diameter of the welding member mounting recess 211*a* is formed to be larger than that of the welding member 213, so that a leaden metal 214 which will be later explained may be inserted between the welding member mounting recess 211*a* and the welding member 213.

Figure 15:
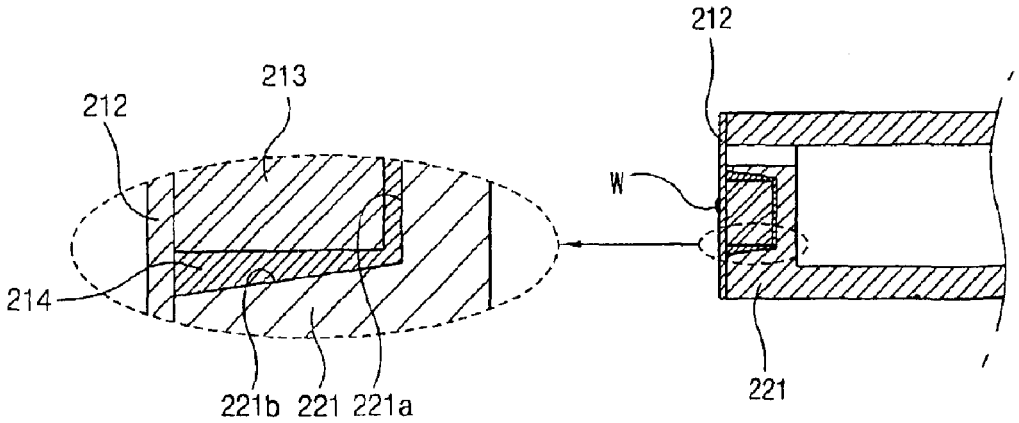
FIG. 15 is a longitudinal section view showing a modification example of a mounting recess formed at the piston in the third preferred embodiment of the suction valve coupling structure for a reciprocating compressor according to the present invention.

A diameter of the welding member mounting recess 211*a* becomes larger toward an outer portion contacted with the atmosphere from an inner portion thereof. As shown in FIGS. 13 and 14, the welding member mounting recess 211*a* can be formed as an extended surface 211*b* chamfered to extend an outer edge thereof, or as shown in FIG. 15, the welding member mounting recess 221*a* can be formed as an extended surface 221*b* of a sectional shape of a trapezoid.

The welding member 213 is formed by stainless having a melting point higher than the leaden metal 214, and welded to the welding member mounting recesses 211*a* and 221*a* by the leaden metal 214.

Unexplained reference numerals G, 6*e*, and W respectively denote bubble, refrigerant suction holes, and a welding point. Hereinafter, a process for fixing the suction valve to the piston of the reciprocating compressor will be explained.

First, the welding member 213 is inserted to the welding member mounting recess 211*a* formed at the end portion surface of the piston 211, and the leaden metal 214 is inserted between the welding member mounting recess 211*a* and the welding member 213, then the leaden metal is heated with a temperature higher than the melting point of the leaden metal 214 so as to weld the piston 211 and the welding member 213, so that the leaden metal 214 melts and permeates between the piston 211 and the welding member 213, thereby reacting the piston 211 with the welding member 213 and cooling them after a predetermined time. According to this, the leaden metal 214 is hardened again and the two members 211 and 213 are welded to each other.

Subsequently, the suction valve 212 corresponds to the end portion surface of the piston 211, and the fixation portion (not shown) of the suction valve 212 is welded to the end portion surface of the welding member 213, thereby completing to fix the suction valve 212.

At this time, bubble is generated as the leaden metal 214 melts by being heated, and the bubble is exhausted to a side contacted with the atmosphere in which density is relatively low. As shown in FIG. 14, the bubble is more formed toward the atmosphere side above the welding member mounting recess 211*a*, so that the leaden metal has a density difference between upper and lower portions. According to this, the bubble G generated at the time when the leaden metal 214 melts is fast exhausted to the atmosphere, so that the bubble G scarcely remains between the piston 211 and the welding member 213, thereby reducing an occurrence rate and a size of a pore in a welding surface between the piston 211 and the welding member 213.

In the meantime, even if the welding member mounting recess 221*a* formed at the end portion surface of the piston 221 is formed as a trapezoid shape, the assembly processes and the operation effects are same.

The third preferred embodiment of the suction valve coupling structure for a reciprocating compressor according to the present invention has the following effects.

In said process, a dead volume between the suction valve and the corresponding discharge valve is removed, and the suction valve is firmly fixed to the piston, so that a slip phenomenon of the suction valve is prevented, thereby increasing a reliability of the compressor.

Also, when the leaden metal for welding the welding member to the piston melts, the bubble generated in the leaden metal is exhausted to the atmosphere, so that amount and a size of the bubble which remains after the welding at the leaden metal and the piston or at the welding surface of the leaden metal and the welding member are greatly reduced, thereby preventing lowering of the welding intensity.

Also, a minute crack generated when a volume of the bubble expands by high temperature at the time of driving the piston is prevented, and corrosion of the piston and the welding member is prevented by controlling a transposition due to a concentration difference caused by the density difference between each pore.

Hereinafter, the fourth preferred embodiment of the suction valve coupling structure for a reciprocating compressor according to the present invention will be explained with reference to the preferred embodiment illustrated in the attached drawings.

Figure 16:
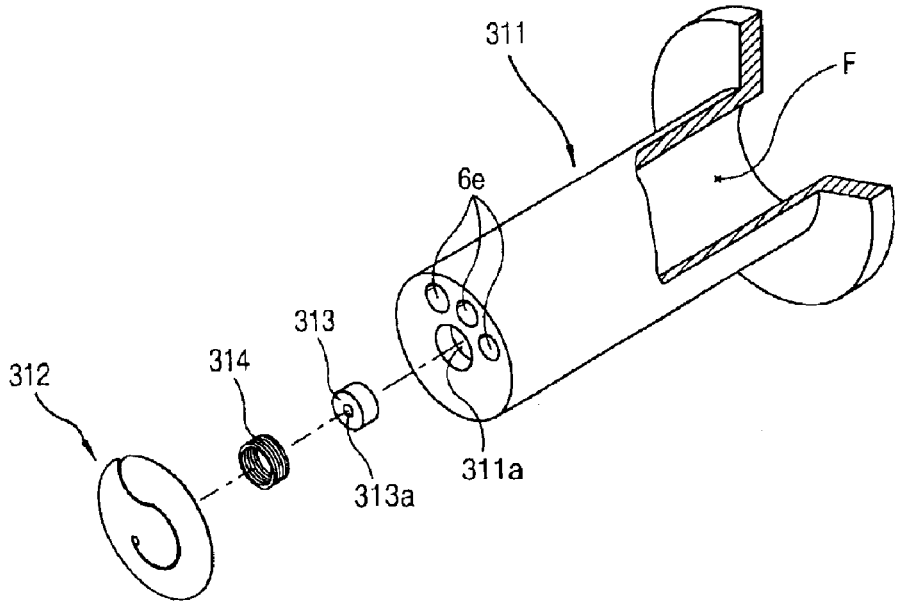
FIG. 16 is a disassembled perspective view showing a fourth preferred embodiment of the suction valve coupling structure for a reciprocating compressor according to the present invention.
Figure 17:
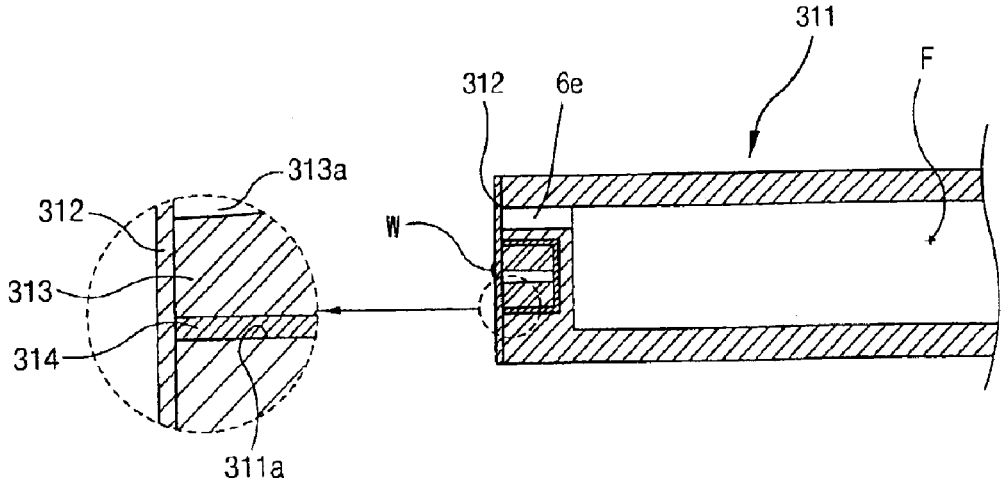
FIG. 17 is a longitudinal section view showing the fourth preferred embodiment of the suction valve coupling structure for a reciprocating compressor according to the present invention.
Figure 18:
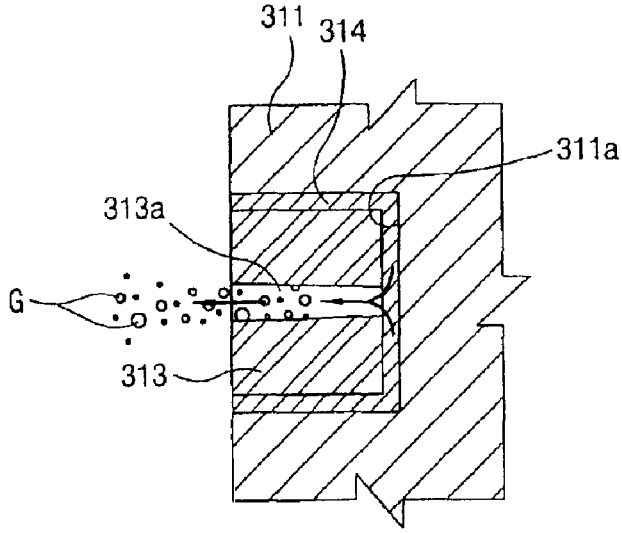
FIG. 18 is a longitudinal section view showing a process that the welding member is welded to the piston in the fourth preferred embodiment of the suction valve coupling structure for a reciprocating compressor according to the present invention.

FIG. 16 is a disassembled perspective view showing an example of the piston of the reciprocating compressor according to the present invention, FIG. 17 is an assembled longitudinal section view showing the example of the piston, and FIG. 18 is a longitudinal section view showing a process that a welding member is welded to the piston.

As shown, the coupling suction valve coupling structure for a reciprocating compressor according to the present invention comprises a piston 311 coupled to an armature of the reciprocating motor (not shown) and slidably inserted to the cylinder 3 for sucking refrigerant gas in the compression space of the cylinder 3, compressing, and discharging; a suction valve 312 mounted at an end portion surface of the piston 311 for opening and closing a refrigerant flow passage F of the piston 311; and a welding member 313 inserted between the end portion surface of the piston 311 and the corresponding suction valve 312 and mounted at the end portion surface of the piston 311 to enhance a welding characteristic of the suction valve 312.

The piston 311 is generally made of cast iron and provided with a welding member mounting recess 313*a* for inserting the welding member 313 at a center of the end portion surface thereof. A diameter of the welding member mounting recess 313*a* is formed to be larger than that of the welding member 313, so that a leaden metal 314 which will be later explained may be inserted between the welding member mounting recess 313*a* and the welding member 313.

Figure 19:
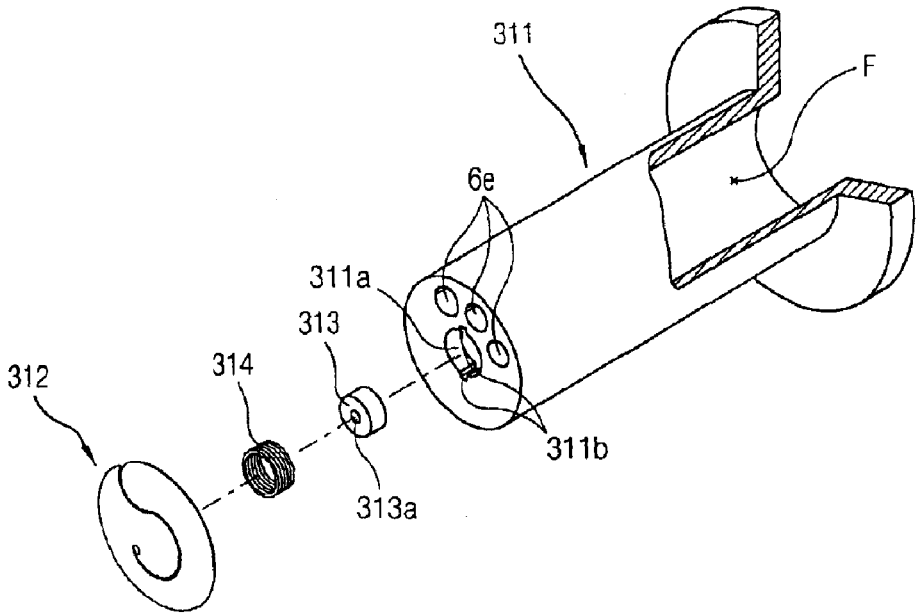
FIG. 19 is a perspective view showing a modification example of the fourth preferred embodiment of the suction valve coupling structure for a reciprocating compressor according to the present invention.

The welding member mounting recess 311*a* has a same diameter from an inner portion thereof to an outer portion contacted with the atmosphere. However, as shown in FIG. 19, it is also possible to form a plurality of channels 311*b* engraved in intaglio from inside to outside of the inner circumference surface.

The welding member 313 is formed by stainless having a melting point higher than the leaden metal 314, and provided with a port 313*a* at a center thereof which is formed to penetrate from an inner portion of the welding member mounting recess 311*a* to an outer portion.

An outer diameter of the port 313*a* contacted to the atmosphere is formed to be larger than an inner diameter of the welding member mounting recess 311*a*.

Unexplained reference numerals G, 6*e*, and W respectively denote bubble, refrigerant suction holes, and a welding point.

Hereinafter, a process for fixing the suction valve to the piston of the reciprocating compressor will be explained.

First, the welding member 313 is inserted to the welding member mounting recess 311*a* formed at the end portion surface of the piston 311, and the leaden metal 314 is inserted between the welding member mounting recess 311*a* and the welding member 313, then the leaden metal 314 is heated with a temperature higher than a melting point of the leaden metal 314 so as to weld the piston 311 and the welding member 313, so that the leaden metal 314 melts and permeates between the piston 311 and the welding member 313, thereby reacting the piston 311 with the welding member 313 metallically and cooling them after a predetermined time. According to this, the leaden metal 314 is again hardened and the two members 311 and 313 are welded to each other.

Subsequently, the suction valve 312 corresponds to the end portion surface of the piston 311, and the fixation portion (not shown) of the suction valve 312 is welded to the end portion surface of the welding member 313, thereby completing to fix the suction valve 312.

At this time, as shown in FIG. 18, bubble is generated as the leaden metal 314 melts by being heated, and the bubble is exhausted to a side contacted with the atmosphere in which density is relatively low. At this time, since the port 313*a* is formed at a center of the welding member 313, the bubble G generated at the time when the leaden metal 314 melts is fast exhausted to the atmosphere through the port 313*a*.

Especially, since a diameter of the port 313*a* is larger towards the atmosphere, the density difference between upper and lower portions of the leaden metal 314 becomes greater, thereby exhausting the bubble G to the atmosphere more faster.

Figure 20:
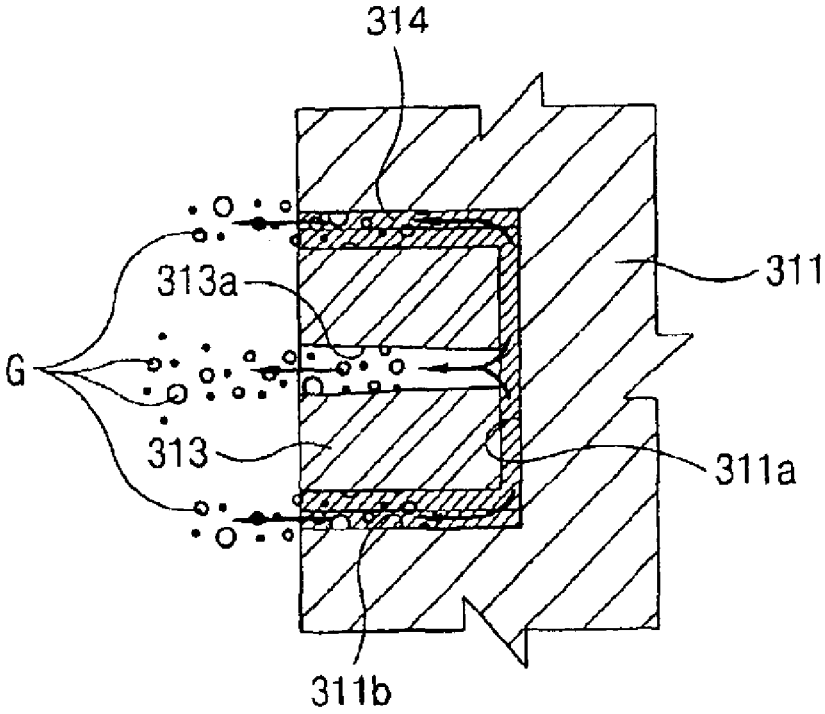
FIG. 20 is a longitudinal section view showing a modification example of the fourth preferred embodiment of the suction valve coupling structure for a reciprocating compressor according to the present invention.

Also, as shown in FIGS. 19 and 20, in case that the channel 311*b* is additionally formed at the welding member mounting recess 311*a* of the piston 311, the bubble G is exhausted to the channel 311*b* of the piston 311 as well as the port 313*a* of the welding member 313, thereby removing the bubble much faster.

The fourth preferred embodiment of the suction valve coupling structure for a reciprocating compressor according to the present invention has the following effects.

A dead volume between the suction valve and the corresponding discharge valve is removed, and the suction valve is firmly fixed to the piston, so that a slip phenomenon of the suction valve is prevented, thereby increasing a reliability of the compressor.

Also, when the leaden metal for welding the welding member to the piston melts, the bubble generated in the leaden metal is exhausted to the atmosphere, so that amount and a size of the bubble which remains after the welding at the leaden metal and the piston or at the welding surface of the leaden metal and the welding member are greatly reduced, thereby preventing lowering of the welding intensity.

Also, a minute crack generated when a volume of the bubble expands by high temperature at the time of driving the piston is prevented, and corrosion of the piston and the welding member is prevented by controlling a transposition due to a concentration difference caused by the density difference between each pore.

INDUSTRIAL APPLICABILITY

As so far described, in the suction valve coupling structure for a reciprocating compressor according to the present invention, a suction valve of a thin plate for opening and closing the refrigerant flow passage is coupled to the piston by welding, so that the coupling state of the suction valve is firm and the coupling structure is simplified. According to this, a dead volume is excluded and a real volume is increased, thereby enhancing compression efficiency. Also, a stroke control of the piston is facilitated, and a movement of the piston can be precisely controlled. Therefore, a reliability of the coupling structure for the suction valve is increased.

Also, a gap between a lateral section surface of the suction valve and a corresponding side of the piston is welded, so that the suction valve is fixed to the piston, thereby removing a dead volume between the suction valve and the corresponding discharge valve and fixing the suction valve firmly to the piston. According to this, a slip phenomenon of the suction valve is prevented, thereby increasing a reliability of the compressor.

Also, in the suction valve coupling structure for a reciprocating compressor according to the present invention, the welding member is inserted to the welding member mounting recess in the piston, the suction valve is coupled to the piston by using the welding member, and the welding member mounting recess expands toward the atmosphere, so that even if bubble is generated at the time when the leaden metal inserted between the welding member mounting recess and the welding member melts, the bubble is fast exhausted to the atmosphere, thereby removing a dead volume between the suction valve and the corresponding discharge valve and fixing the suction valve firmly to the piston. According to this, a slip phenomenon of the suction valve is prevented, thereby increasing a reliability of the compressor.

Also, a welding intensity of a welding surface between each member and the leaden metal inserted therebetween is prevented from being lowered, a minute crack generated when a volume of the bubble expands by high temperature at the time of driving the piston is prevented, and corrosion of the piston and the welding member is prevented by controlling a transposition due to a concentration difference caused by the density difference between each pore.

Also, in the suction valve coupling structure for a reciprocating compressor according to the present invention, the welding member is inserted to the welding member mounting recess in the piston, the suction valve is coupled to the piston by using the welding member, and the port is formed at the welding member mounted at the piston or the port is additionally formed at an inner circumference surface of the welding member mounting recess for inserting the welding member so as to weld the suction valve, so that even if bubble is generated at the time when the leaden metal inserted between the welding member mounting recess and the welding member melts, the bubble is fast exhausted to the atmosphere, thereby removing a dead volume between the suction valve and the corresponding discharge valve and fixing the suction valve firmly to the piston. According to this, a slip phenomenon of the suction valve is prevented, thereby increasing a reliability of the compressor.

Also, a welding intensity of a welding surface between each member and the leaden metal inserted therebetween is prevented from being lowered, a minute crack generated when a volume of the bubble expands by high temperature at the time of driving the piston is prevented, and corrosion of the piston and the welding member is prevented by controlling a transposition due to a concentration difference caused by the density difference between each pore.

What is claimed is:

1. A suction valve coupling structure for a reciprocating compressor, wherein the reciprocating compressor comprises: a piston for linearly reciprocating in a cylinder with an armature of a reciprocating motor and having a refrigerant flow passage connected to the end portion surface thereof; and a suction valve arranged at the end portion surface of the piston for opening and closing the refrigerant flow passage, said suction valve coupling structure comprising;

a welding member mounting recess having a predetermined depth formed at the end portion surface of the piston to mount the suction valve thereat; and a welding member welded to the suction valve inserted into the welding member mounting recess, wherein a diameter of the welding member mounting recess becomes larger from an inner portion thereof toward an outer portion contacted with the atmosphere so as to easily exhaust bubble generated at the time when leaden metal is melted.

2. The structure of claim 1, wherein the welding member mounting recess is formed at a center of the end portion surface of the piston.

3. The structure of claim 1, wherein the welding member is coupled to the welding member mounting recess by brazing.

4. The structure of claim 1, wherein the welding member mounting recess is filled with welding material comprising the welding member, and the suction valve for opening and closing the refrigerant flow passage is welded to the piston head via the welding material which fills the welding member mounting recess.

5. The structure of claim 1, wherein an opening of the welding member mounting recess is formed by chamfering to extend an outer edge thereof outwardly.

6. The structure of claim 1, wherein a port toward an outer portion from an inner portion of the welding member mounting recess is formed at a center of the welding member which is welded to the welding member mounting recess formed at the end portion surface of the piston, thereby easily exhausting bubbles generated during fabrication of the structure.

7. The structure of claim 6, wherein a diameter of the port becomes larger from an inner portion of the welding member mounting recess toward an outer portion.

8. The structure of claim 6, further comprising a channel at an inner circumference surface of the welding member mounting recess.

9. A reciprocating compressor and a suction valve coupling structure for the reciprocating compressor, the reciprocating compressor comprising: a piston for linearly reciprocating in a cylinder with an armature of a reciprocating motor and having a refrigerant flow passage connected to the end portion surface thereof; and a suction valve arranged at the end portion surface of the piston for opening and closing the refrigerant flow passage, wherein the suction valve is welded to the piston by directly welding a lateral section surface thereof to the corresponding surface of the pistons, wherein an insertion recess is formed at the end portion surface of the piston, and a welding material is forcibly pressed into the insertion recess, thereby welding the lateral section surface of the suction valve to the end portion surface of the welding material, wherein a welding hole is formed at the suction valve corresponding to the welding material, and the lateral section surface of the welding hole is welded to the end portion surface of the welding material, and wherein a diameter of the insertion recess becomes larger from an inner portion thereof toward an outer portion contacted with the atmosphere so as to easily exhaust bubbles generated at the time when leaden metal is melted.

10. The structure of claim 9, wherein a lateral section surface of a cut-off which divides the suction valve into an open/close portion and a fixation portion is welded to the end portion surface of the welding material.

11. The structure of claim 10, wherein an outer circumference surface of the suction valve is further welded to an outer circumference surface of an end portion of the corresponding piston.

* * * * *